US009501043B2

(12) United States Patent
Heck et al.

(10) Patent No.: US 9,501,043 B2
(45) Date of Patent: Nov. 22, 2016

(54) FLEXIBLE PORTABLE ELECTRONIC DEVICE

(71) Applicant: THE SWATCH GROUP RESEARCH AND DEVELOPMENT LTD, Marin (CH)

(72) Inventors: Pascal Heck, Erlach (CH); Cedric Nicolas, Neuchatel (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 14/435,582

(22) PCT Filed: Sep. 5, 2013

(86) PCT No.: PCT/EP2013/068370

§ 371 (c)(1),
(2) Date: Apr. 14, 2015

(87) PCT Pub. No.: WO2014/095098

PCT Pub. Date: Jun. 26, 2014

(65) Prior Publication Data

US 2015/0362894 A1 Dec. 17, 2015

(30) Foreign Application Priority Data

Dec. 17, 2012 (EP) ..... 12197479

(51) Int. Cl.
*G04G 17/08* (2006.01)
*A44C 5/00* (2006.01)

(52) U.S. Cl.
CPC ..... *G04G 17/08* (2013.01); *A44C 5/0015* (2013.01)

(58) Field of Classification Search
CPC ..... G04B 17/08; A44C 5/00; A44C 5/0053; A44C 5/0061; A44C 5/0069; A44C 5/0076
USPC ..... 368/282
See application file for complete search history.

(56) References Cited

U.S. PATENT DOCUMENTS 2,986,313 A * 5/1961 Swecker, Jr. ..... A44C 5/0053 224/171
4,847,818 A * 7/1989 Olsen ..... G04B 47/025 224/165

(Continued)

FOREIGN PATENT DOCUMENTS

EP 2484243 A1 8/2012
WO 2006/039859 A1 4/2006
WO 2011/103317 A1 8/2011

OTHER PUBLICATIONS

Definition of "Bellows" from Illustrated Professional Dictionary of Horology, obtained Nov. 17, 2015.*

(Continued)

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A flexible portable electronic device capable of generating information includes a flexible body configured to be attached to a part of a user's body, the flexible body including a lower flexible band that gives the flexible portable electronic device thickness and mechanical resistance and an upper flexible band fixed to the lower flexible band, and an electronic assembly to generate information, the electronic assembly being housed between the lower flexible band and the upper flexible band. At least two successive bellows each including at least one fold are separated from each other by a transverse reinforcing element at one location on a length of the lower flexible band. The reinforcing element extends transversely to a longitudinal axis of symmetry of the flexible body and is secured to the lower flexible band. The bellows are configured to compress and relax along the longitudinal axis of symmetry of the flexible body.

10 Claims, 2 Drawing Sheets

(56) References Cited

U.S. PATENT DOCUMENTS 5,179,733 A * 1/1993 Matsui ..... H01Q 1/273 368/282
5,244,134 A * 9/1993 Riley ..... A44C 5/0053 224/152
5,258,746 A * 11/1993 Leitten ..... G08B 21/0297 340/384.6
5,479,381 A * 12/1995 Goldenberg ..... G04B 19/23 224/175
5,526,006 A * 6/1996 Akahane ..... B29C 45/14065 224/165
6,249,487 B1 * 6/2001 Yano ..... G01S 19/34 342/357.74
6,416,217 B1 * 7/2002 Von Braunhut ..... G04B 47/044 368/10
6,728,160 B1 * 4/2004 Yang ..... G11C 7/1051 365/189.05
2003/0026171 A1 2/2003 Brewer et al.
2007/0064412 A1 * 3/2007 Radley-Smith ..... A44C 5/0015 362/104
2010/0243688 A1 * 9/2010 Gutierrez ..... A44C 5/025 224/175
2011/0235475 A1 * 9/2011 Shindo ..... G04B 43/002 368/281
2012/0201104 A1 8/2012 Amenduni Gresele
2012/0314546 A1 12/2012 Brewer et al.
2013/0329532 A1 * 12/2013 Sorias ..... G04C 10/00 368/64

OTHER PUBLICATIONS

International Search Report issued Oct. 2, 2013 in PCT/EP2013/068370 filed Sep. 5, 2013.

* cited by examiner

FLEXIBLE PORTABLE ELECTRONIC DEVICE

The present invention concerns a flexible portable electronic device intended to be wound around a part of the user's body. More particularly, the present invention concerns a flexible portable electronic device, for example of the wristwatch type.

The present invention relates to a flexible portable electronic device which is essentially formed of a flexible body that takes the form of a bracelet with strands intended to be wound around a part of the user's body. The flexible body is formed of a lower flexible band and an upper flexible band secured to the lower flexible band by any appropriate means, such as adhesive bonding or welding, in particular thermal welding. The lower flexible band may be made of any plastic material, such as an elastomer, which gives the flexible portable electronic device thickness and high mechanical resistance. The upper flexible band is a thin film made of any water resistant plastic material.

The flexible portable electronic device is completed by an electronic assembly capable of generating at least one item of information. This electronic assembly for generating information is disposed between the lower flexible band and the upper flexible band. In the case where the flexible portable electronic object is of the wristwatch type, the electronic assembly must be at least capable of generating and of displaying information, typically time information. To this end, the electronic assembly for generating and displaying information is formed of a device for the display of information, such as a liquid crystal display cell, and of a printed circuit board on which are mounted the various discrete and integrated electronic components required for the proper operation of the portable electronic device, in particular a time base. The electronic assembly for generating and displaying information is completed by an electric power supply device such as a battery.

The flexible portable electronic device forming the subject of the present invention is intended to be wound around a part of a user's body, such as the wrist. It will be understood that the portable electronic device is in contact with the user's wrist via the lower flexible band which is thicker than the upper flexible band to give the portable electronic device thickness and mechanical resistance. Moreover, the upper and lower flexible bands have different coefficients of elasticity. The lower flexible band has a smaller radius of curvature than that of the upper flexible band and is therefore compressed with respect to the upper flexible band. When the compression becomes too great to be borne by the material of the lower flexible band, the latter forms a series of bulges, which causes aesthetic problems and is detrimental to the wearing comfort of the electronic device.

It is an object of the present invention to overcome these drawbacks, in addition to others, by providing a portable electronic device wherein the lower flexible band, which gives the portable electronic device its thickness and its shape, is deformed homogeneously without forming unsightly folds when the electronic device is worn on a user's wrist.

To this end, the present invention concerns a flexible portable electronic device capable of generating an item of information, this flexible portable electronic device including a flexible body arranged to be capable of attachment to a part of the user's body, the flexible body including a lower flexible band which gives the flexible portable electronic device thickness and mechanical resistance, and an upper flexible band secured to the lower flexible band, the flexible portable electronic device including an electronic assembly for generating information, the electronic assembly for generating information being housed between the lower flexible band and the upper flexible band of the flexible body, the flexible portable electronic device being characterized in that at least one reinforcing element extending transversely to a longitudinal axis of symmetry of the flexible body is joined to the lower flexible band.

According to a second embodiment of the invention, the flexible portable electronic device capable of generating an item of information includes a flexible body arranged to be capable of attachment to a part of a user's body, the flexible body including a lower flexible band which gives the flexible portable electronic device thickness and mechanical resistance, and an upper flexible band secured to the lower flexible band, the flexible portable electronic device including an electronic assembly for generating an item of information, the electronic assembly for generating information being housed between the lower flexible band and the upper flexible band of the flexible body, the flexible portable electronic device being characterized in that at least one bellows including at least one fold is arranged at one location on the length of the upper flexible band, the bellows being capable of compressing and of relaxing in a direction of longitudinal symmetry of the flexible portable electronic device.

According to a third embodiment of the invention, the lower flexible band includes a combination of at least one transverse reinforcing element and at least one bellows.

As a result of these features, the present invention provides a flexible portable electronic device whose lower flexible band, which gives the flexible portable electronic device thickness and mechanical resistance, is provided with transverse reinforcing elements and/or bellows whose purpose is to prevent excessive compression of the lower flexible band fostering the appearance of unsightly bulges detrimental to the wearing comfort of the electronic device. Indeed, the transverse reinforcements behave like rectilinear beams clamped at both ends between the lower flexible band and the upper flexible band, these rectilinear beams completely or almost completely preventing the formation of transverse bulges in the lower flexible band. Likewise, the presence of bellows results in a partial absence of material at the locations on the lower flexible band where the bellows are provided. Consequently, at the bellows locations, the lower flexible band has a higher rate of compressibility, which, combined with the fact that the bellows are arranged to be compressed and to be relaxed in a longitudinal direction of the flexible body, prevents the appearance of longitudinal bulges in the material of the lower flexible band.

Other features and advantages of the present invention will appear more clearly from the following detailed description of one embodiment of the flexible portable electronic device according to the invention, this example being given solely by way of non-limiting illustration with reference to the annexed drawing, in which.

The present invention proceeds from the general inventive idea which consists in providing a flexible portable electronic device including a lower flexible band and an upper flexible band secured to the lower flexible band wherein the lower flexible band, which gives the portable electronic device thickness and mechanical resistance, is provided with means intended to prevent the formation of bulges when the electronic device is wound, for example around a user's wrist. To this end, the present invention provides that the lower flexible band is fitted with reinforcing elements extending in a transverse direction to a direction of longitudinal symmetry of the portable electronic device. These reinforcing elements, clamped at both ends between the lower flexible band and the upper flexible band, prevent the appearance of bulges in the lower flexible band in a transverse direction of the portable electronic object. According to another embodiment of the invention, the present invention teaches the forming of one or more bellows in the lower flexible band, each including at least one fold and which are compressed and relaxed in a direction of longitudinal symmetry of the portable electronic device. At the bellows locations, the material of the lower flexible band is partially absent, which improves the rate of compressibility of the lower flexible band and prevents the appearance of bulges in the longitudinal direction of portable electronic device. Finally, according to a third variant, the transverse reinforcements and the bellows are advantageously combined to prevent any transverse and longitudinal deformation of the lower flexible band.

Figure 1:
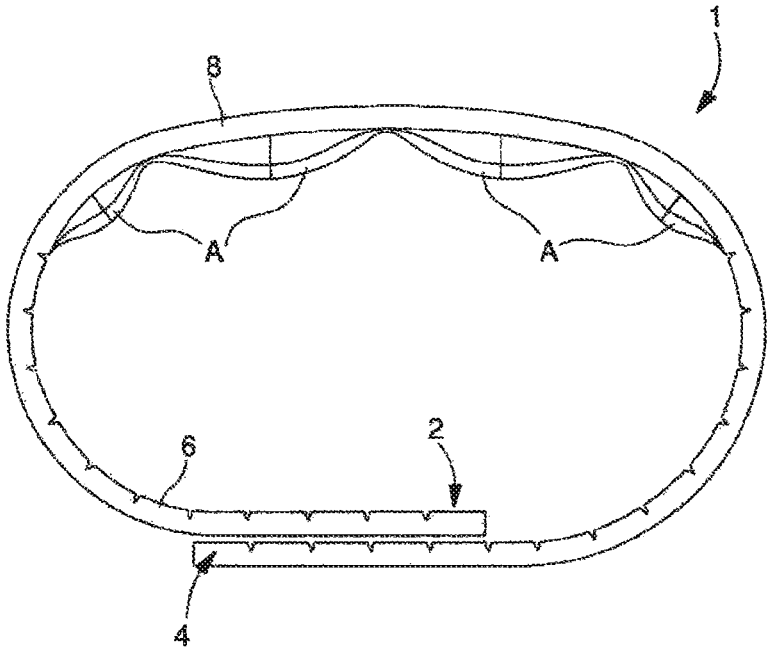
Fig. 1 Background Art
FIG. 1 is a schematic profile view of a flexible portable electronic device according to the prior art in a wound position which reveals the bulges in the lower flexible band.

FIG. 1 is a profile view of a flexible portable electronic device according to the prior art. Designated as a whole by the general reference numeral 1, the portable electronic device according to the prior art is shown in the wound state that occurs when it is worn around a part of the user's body, such as the wrist. The portable electronic device 1 takes the form of a flexible band formed of two bracelet strands 2 and 4 wound one above the other in the worn state. Portable electronic device 1 includes a lower flexible band 6 and an upper flexible band 8 secured to lower flexible band 6 by any appropriate means such as adhesive bonding or welding, in particular thermal welding. Lower flexible band 6 is made of any plastic material, such as an elastomer, which gives portable electronic device 1 thickness and high mechanical resistance. As regards upper flexible band 8, this is a thin film made of a waterproof plastic material.

In the wound state illustrated in FIG. 1, it is seen that, on the side via which lower flexible band 6 is in contact, for example, with a wearer's wrist, lower flexible band 6 has a series of bulges designated by the alphabetic reference A. These bulges, caused by the curvature of portable electronic device 1 and by the difference between the coefficients of elasticity of the materials that respectively form lower flexible band 6 and upper flexible band 8, are detrimental to the aesthetic appearance and wearing comfort of portable electronic device 1.

Figure 2:
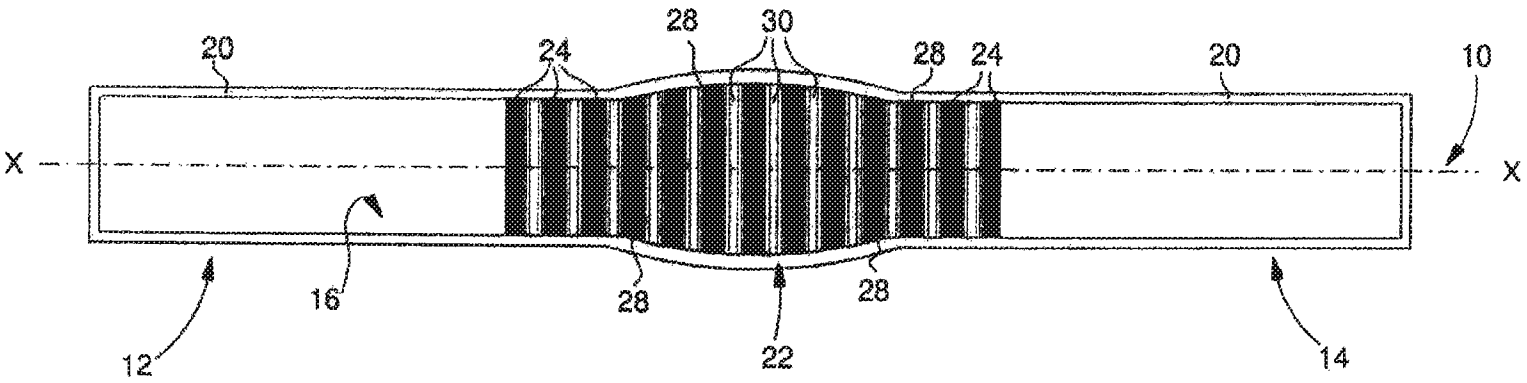
FIG. 2 is a schematic top view of the portable electronic device according to the invention.
Figure 3:
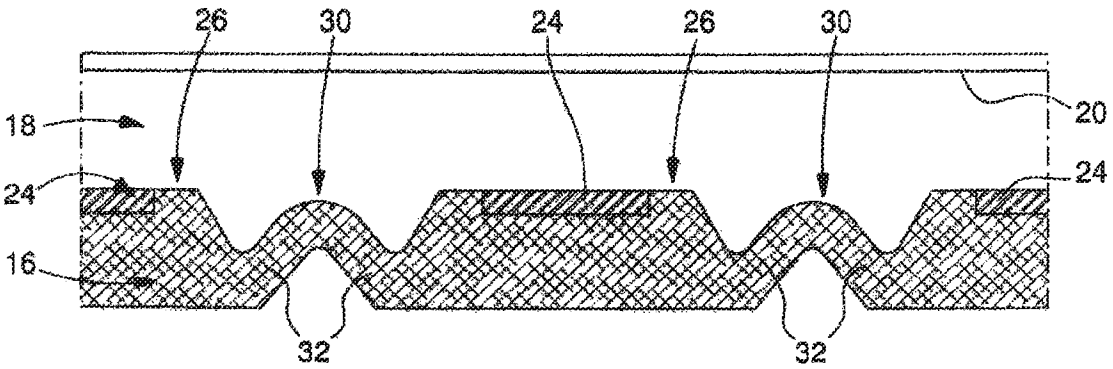
FIG. 3 is a partial cross-sectional view of the portable electronic device of FIG. 2 in the area of the transverse reinforcements and bellows.

It is an object of the present invention to overcome the aforementioned problem by proposing a flexible portable electronic device as illustrated in FIGS. 2 and 3 annexed to the present Patent Application. Designated as a whole by the general reference numeral 10, flexible portable electronic device 10 according to the invention is of a similar type to that of flexible portable electronic device 1 according to the prior art discussed above with reference to FIG. 1. In particular, flexible portable electronic device 10 according to the invention includes a flexible body that takes the form of a flexible band formed of two bracelet strands 12 and 14, disposed in the extension of each other, and wound one above the other in the worn state of portable electronic device 10. The flexible body is formed of a lower flexible band 16, for example, but not restrictively, made of elastomer, and of an upper flexible band 18 made of a thin, water resistant plastic material and secured to an outer perimeter 20 of lower flexible band 16. It will be understood that upper flexible band 18 may also, if necessary, be bonded over the entire surface of lower flexible band 16.

Flexible portable electronic device 10 according to the invention is intended to at least generate an item of information, and, according to a preferred but non-limiting variant of the invention, to generate and to display time information. In this latter case, portable electronic device 10 is provided with an electronic assembly for generating and displaying information (not illustrated in FIGS. 2 and 3) including at least one information display device such as a liquid crystal display device, a printed circuit board on which are fixed the discrete and integrated electronic components required for displaying the time, and a flexible battery. These various components are of generally rectangular, flat shape and are arranged one on top of the other. The electronic assembly formed by these components is disposed in a housing 22 delimited within lower flexible band 16.

According to the invention, at least one, and preferably a plurality, of reinforcing elements 24 are secured to lower flexible band 16. These reinforcing elements 24 extend transversely to a direction of longitudinal symmetry X-X of flexible portable electronic device 10. These reinforcing elements 24 are fixed to lower flexible band 16 by adhesive bonding or by over-moulding the material of which lower flexible band 16 is made. These reinforcing elements 24 are preferably disposed on an upper face 26 of lower flexible band 16 intended to be covered by upper flexible band 18. However, according to a variant, reinforcing elements 24 may also be embedded in the material of lower flexible band 16. Reinforcing elements 24 are preferably placed in the area of housing 22 and in the areas of bracelet strands 12 and 14 adjacent to housing 22.

As revealed by an examination of the Figures, transverse reinforcing elements 24 take the form of rectilinear beams whose ends extend substantially as far as outer perimeter 20 of lower flexible band 16, so that when upper flexible band 18 is fixed to lower flexible band 16, the ends 28 of transverse reinforcing elements 24 are clamped between lower flexible band 16 and upper flexible band 18. Consequently, transverse reinforcing elements 24 prevent lower flexible band 16 from deforming transversely when portable electronic device 10 according to the invention is wound around a user's wrist.

The transverse reinforcing elements 24 described above are sufficient in themselves to improve the aesthetic appearance and wearing comfort of portable electronic device 10 when the latter is wound around a user's wrist. However, according to a second aspect of the invention, there is arranged in lower flexible band 16 at least one and preferably a plurality of bellows 30 each formed of two folds 32 which are compressed and are relaxed in the direction of longitudinal symmetry X-X of portable electronic device 10 according to the invention. Preferably, two successive bellows 30 are separated from each other by a transverse reinforcing element 24. It will be understood that the presence of bellows 30 results in a partial absence of material at the locations on lower flexible band 16 where bellows 30 are provided. Consequently, at the locations of bellows 30, lower flexible band 16 has a higher rate of compressibility, which, combined with the fact that the bellows 30 are arranged to be compressed and to be relaxed in a longitudinal X-X of the flexible body, prevents the appearance of longitudinal bulges in the material of lower flexible band 16.

Thus, combining transverse reinforcing elements 24 with bellows 30 prevents both the transverse deformations and the longitudinal deformations of the flexible material of which lower flexible band 16 is made. It will be understood, however, that very satisfactory results are obtained simply by using transverse reinforcing elements 24 or simply bellows 30.

It goes without saying that this invention is not limited to the embodiment that has just been described and that various simple modifications and variants can be envisaged by those skilled in the art without departing from the scope of the invention as defined by the annexed claims.

The invention claimed is:

1. A flexible portable electronic device capable of generating an item of information, the flexible portable electronic device comprises:

a flexible body configured to be attached to a part of a user's body, wherein the flexible body includes a lower flexible band that gives the flexible portable electronic device thickness and mechanical resistance, and an upper flexible band fixed to the lower flexible band; and an electronic assembly to generate information, wherein the electronic assembly to generate information is housed between the lower flexible band and the upper flexible band of the flexible body, wherein at least two successive bellows each including at least one fold are separated from each other by a transverse reinforcing element at one location on a length of the lower flexible band, wherein the reinforcing element extends transversely to a longitudinal axis of symmetry of the flexible body and is secured to the lower flexible band, wherein the bellows are configured to compress and relax along the longitudinal axis of symmetry of the flexible body, and wherein at least a portion of an upper surface of the bellows contacts a lower surface of the upper flexible band.

2. The flexible portable electronic device according to claim 1, wherein ends of the transverse reinforcing element are clamped between the lower flexible band and the upper flexible band.

3. The flexible portable electronic device according to claim 1, wherein the upper flexible band is secured to an outer perimeter of the lower flexible band.

4. The flexible portable electronic device according to claim 1, wherein the electronic assembly to generate information is housed between the lower flexible band and the upper flexible band in an area of the flexible body that includes the bellows and the transverse reinforcing element.

5. The flexible portable electronic device according to claim 1, wherein the flexible portable electronic device includes more than one of the transverse reinforcing element, and the transverse reinforcing elements are separated from each other by at least one of the bellows.

6. A flexible portable electronic device capable of generating an item of information, the flexible portable electronic device comprises:

a flexible body configured to be attached to a part of a user's body, wherein the flexible body includes a lower flexible band that gives the flexible portable electronic device thickness and mechanical resistance, and an upper flexible band fixed to the lower flexible band; and an electronic assembly to generate information, wherein the electronic assembly to generate information is housed between the lower flexible band and the upper flexible band of the flexible body, wherein at least two successive bellows each including at least one fold are separated from each other by a transverse reinforcing element at one location on a length of the lower flexible band, wherein the reinforcing element extends transversely to a longitudinal axis of symmetry of the flexible body and is secured to the lower flexible band, wherein the bellows are configured to compress and relax along the longitudinal axis of symmetry of the flexible body, and wherein ends of the transverse reinforcing element are clamped between the lower flexible band and the upper flexible band.

7. The flexible portable electronic device according to claim 6, wherein at least a portion of an upper surface of the bellows contacts a lower surface of the upper flexible band.

8. The flexible portable electronic device according to claim 6, wherein the upper flexible band is secured to an outer perimeter of the lower flexible band.

9. The flexible portable electronic device according to claim 6, wherein the electronic assembly to generate information is housed between the lower flexible band and the upper flexible band in an area of the flexible body that includes the bellows and the transverse reinforcing element.

10. The flexible portable electronic device according to claim 6, wherein the flexible portable electronic device includes more than one of the transverse reinforcing element, and the transverse reinforcing elements are separated from each other by at least one of the bellows.

* * * * *